US007719504B2

(12) United States Patent
Wang et al.

(10) Patent No.: US 7,719,504 B2
(45) Date of Patent: May 18, 2010

(54) LIQUID CRYSTAL DISPLAY AND DRIVING METHOD THEREOF

(75) Inventors: Chih-Wei Wang, Hsin-Chu (TW); Ming-Sheng Lai, Hsin-Chu (TW); Hsueh-Ying Huang, Hsin-Chu (TW); Yu-Hui Chou, Hsin-Chu (TW)

(73) Assignee: AU Optronics Corp., Hsin-Chu (TW)

( * ) Notice: Subject to any disclaimer, the term of this patent is extended or adjusted under 35 U.S.C. 154(b) by 667 days.

(21) Appl. No.: 11/686,541

(22) Filed: Mar. 15, 2007

(65) Prior Publication Data

US 2008/0084370 A1 Apr. 10, 2008

(30) Foreign Application Priority Data

Oct. 5, 2006 (TW) ..... 95137211 A

(51) Int. Cl.
*G09G 3/36* (2006.01)

(52) U.S. Cl. ..... 345/87; 345/88; 345/89; 345/93; 345/95; 345/690

(58) Field of Classification Search ..... 345/87–104, 345/204–215, 690; 349/149–166
See application file for complete search history.

(56) References Cited

U.S. PATENT DOCUMENTS

| | | | | |
|---|---|---|---|---|
| 5,233,338 | A | 8/1993 | Surguy | |
| 6,115,104 | A | 9/2000 | Nakatsuka | |
| 6,188,379 | B1 | 2/2001 | Kaneko | |
| 6,327,008 | B1 | 12/2001 | Fujiyoshi | |
| 6,489,952 | B1 | 12/2002 | Tanaka et al. | |
| 6,570,554 | B1 | 5/2003 | Makino et al. | |
| 6,703,993 | B2 | 3/2004 | Miura et al. | |
| 6,836,265 | B1 | 12/2004 | Lee et al. | |
| 6,836,625 | B2 | 12/2004 | Shiratori | |
| 7,586,568 | B2 * | 9/2009 | Wu et al. | 349/114 |
| 2008/0084370 | A1 * | 4/2008 | Wang et al. | 345/87 |
| 2008/0094553 | A1 * | 4/2008 | Wu et al. | 349/114 |
| 2008/0297709 | A1 * | 12/2008 | Eguchi | 349/139 |

FOREIGN PATENT DOCUMENTS

| | | |
|---|---|---|
| TW | 432348 | 5/2001 |
| TW | 550415 | 9/2003 |
| TW | I226957 | 1/2005 |

* cited by examiner

*Primary Examiner*—Vijay Shankar
(74) *Attorney, Agent, or Firm*—Thomas, Kayden, Horstemeyer & Risley

(57) ABSTRACT

A liquid crystal display and a driving method thereof. A gate driver drives a first pixel of the display via a first scanning line within a frame period including first and second data writing intervals. A first data voltage and a second data voltage are transmitted to the first pixel in the first and second data writing intervals, respectively. After the first data writing interval, a first color light source illuminates the first pixel. After the second data writing interval, a second color light source illuminates the first pixel. In a reset interval between the first and second data writing intervals, a voltage of a common line coupled to a storage capacitor of the first pixel is changed from a first common voltage to a second common voltage so that a voltage of a first liquid crystal capacitor of the first pixel is changed.

18 Claims, 8 Drawing Sheets

LIQUID CRYSTAL DISPLAY AND DRIVING METHOD THEREOF

This application claims the benefit of Taiwan application Ser. No. 95137211, filed Oct. 5, 2006, the subject matter of which is incorporated herein by reference.

BACKGROUND OF THE INVENTION

1. Field of the Invention

The invention relates in general to a liquid crystal display and a driving method thereof, and more particularly to a liquid crystal display and a driving method thereof for driving pixels according to a color sequential method.

2. Description of the Related Art

With the thinned trend of the display, liquid crystal displays are widely used in various electronic products, such as a mobile phone, a notebook computer and a color television. The conventional color liquid crystal display achieves the color displaying effect using red, green and blue color filters. Unlike the conventional display principle, the liquid crystal display for driving pixels according to the color sequential method achieves the color displaying effect using red, green and blue colors of light sources to display the colors directly through a backlight module and then using the continuous color addition.

However, because the color sequential method has to divide one frame period into three sub-frame periods so that the red, green and blue colors of light sources turn on within different sub-frame periods to mix the colors. Assume a display frame completely turns from black to white and is scanned from top to bottom sequentially within a sub-frame period. When the response speed of the liquid crystal is not high enough, liquid crystal molecules in a lower half portion of a panel do not reach the complete response state yet when the color light source turns on so that the corresponding pixels cannot reach the required brightness. At this time, the brightness of the display frame in the lower half portion of the panel is lower than the brightness of the display frame in an upper half portion of the panel, and the overall frame brightness is not uniform.

Similarly, assume the display frame completely turns from white to black and is scanned from top to bottom sequentially within the sub-frame period. When the response speed of the liquid crystal is not high enough, the liquid crystal molecules in the lower half portion of the panel cannot reach the complete response state yet when the color light source turns on so that the corresponding pixels cannot reach the required black frame. At this time, the color of the display frame in the lower half portion of the panel is different from the color of the display frame in the upper half portion of the panel, so the overall frame color is not uniform or the mixed color is incorrect.

SUMMARY OF THE INVENTION

The invention is directed to a liquid crystal display and a driving method thereof capable of improving the non-uniform color or the incorrectly mixed color to enhance the image quality of the display.

According to a first aspect of the present invention, a liquid crystal display is provided. This liquid crystal display includes a first substrate, a second substrate, a liquid crystal layer, at least one first color light source and a second color light source, a gate driver and a common line. The first substrate includes a common electrode. The second substrate includes at least one data line, at least one scanning line and a pixel array. The pixel array is coupled to the at least one data line and the at least one scanning line. The pixel array includes a first pixel having a first storage capacitor and a first pixel electrode. The liquid crystal layer is disposed between the first substrate and the second substrate. The common electrode, the first pixel electrode and the liquid crystal layer form a first liquid crystal capacitor. The gate driver drives the pixel array through the at least one scanning line within a frame period. The frame period includes a first sub-frame period and a second sub-frame period. The first sub-frame period includes a first data writing interval, and the second sub-frame period includes a second data writing interval. The common line provides at least one first common voltage and a second common voltage. The first storage capacitor is coupled to and between the common line and the first pixel electrode.

In the first data writing interval, a first data voltage is transmitted to the first pixel. After the first data writing interval, the first color light source illuminates the first pixel. In the second data writing interval, a second data voltage is transmitted to the first pixel. After the second data writing interval, the second color light source illuminates the first pixel. In a reset interval between the first data writing interval and the second data writing interval, a voltage of the common line is changed from the first common voltage to the second common voltage so that the voltage of the first liquid crystal capacitor is changed.

According to a second aspect of the present invention, a liquid crystal display is provided. The liquid crystal display includes a first substrate, a second substrate, a liquid crystal layer, at least one first color light source and a second color light source and a gate driver. The first substrate includes a common electrode. The second substrate includes at least one data line, multiple scanning lines and a pixel array. The at least one data line includes a first data line. The scanning lines include a first scanning line and a second scanning line. The pixel array is coupled to the at least one data line and the scanning lines. The pixel array includes a first pixel and a second pixel. The first pixel is coupled to the first data line and the first scanning line, and the second pixel is coupled to the first data line and the second scanning line. The first pixel has a first storage capacitor and a first pixel electrode, and the second pixel has a second storage capacitor and a second pixel electrode. The liquid crystal layer is disposed between the first substrate and the second substrate. The common electrode, the first pixel electrode and the liquid crystal layer form a first liquid crystal capacitor, while the common electrode, the second pixel electrode and the liquid crystal layer form a second liquid crystal capacitor. The gate driver drives the pixel array through the scanning lines within a frame period. The frame period includes a first sub-frame period and a second sub-frame period. The first sub-frame period includes a first data writing interval, while the second sub-frame period includes a second data writing interval.

In the first data writing interval, a first data voltage and a second data voltage are respectively transmitted to the first pixel and the second pixel. After the first data writing interval, the first color light source illuminates the first pixel and the second pixel. In the second data writing interval, a third data voltage and a fourth data voltage are respectively transmitted to the first pixel and the second pixel. After the second data writing interval, the second color light source illuminates the first pixel and the second pixel. In a first pulse cycle between the first data writing interval and the second data writing interval, the first scanning line and the second scanning line are simultaneously enabled, while a predetermined voltage is inputted to the first pixel and the second pixel to change the voltages of the first liquid crystal capacitor and the second liquid crystal capacitor simultaneously.

The invention will become apparent from the following detailed description of the preferred but non-limiting embodiments. The following description is made with reference to the accompanying drawings.

DETAILED DESCRIPTION OF THE INVENTION

First Embodiment

Figure 1:
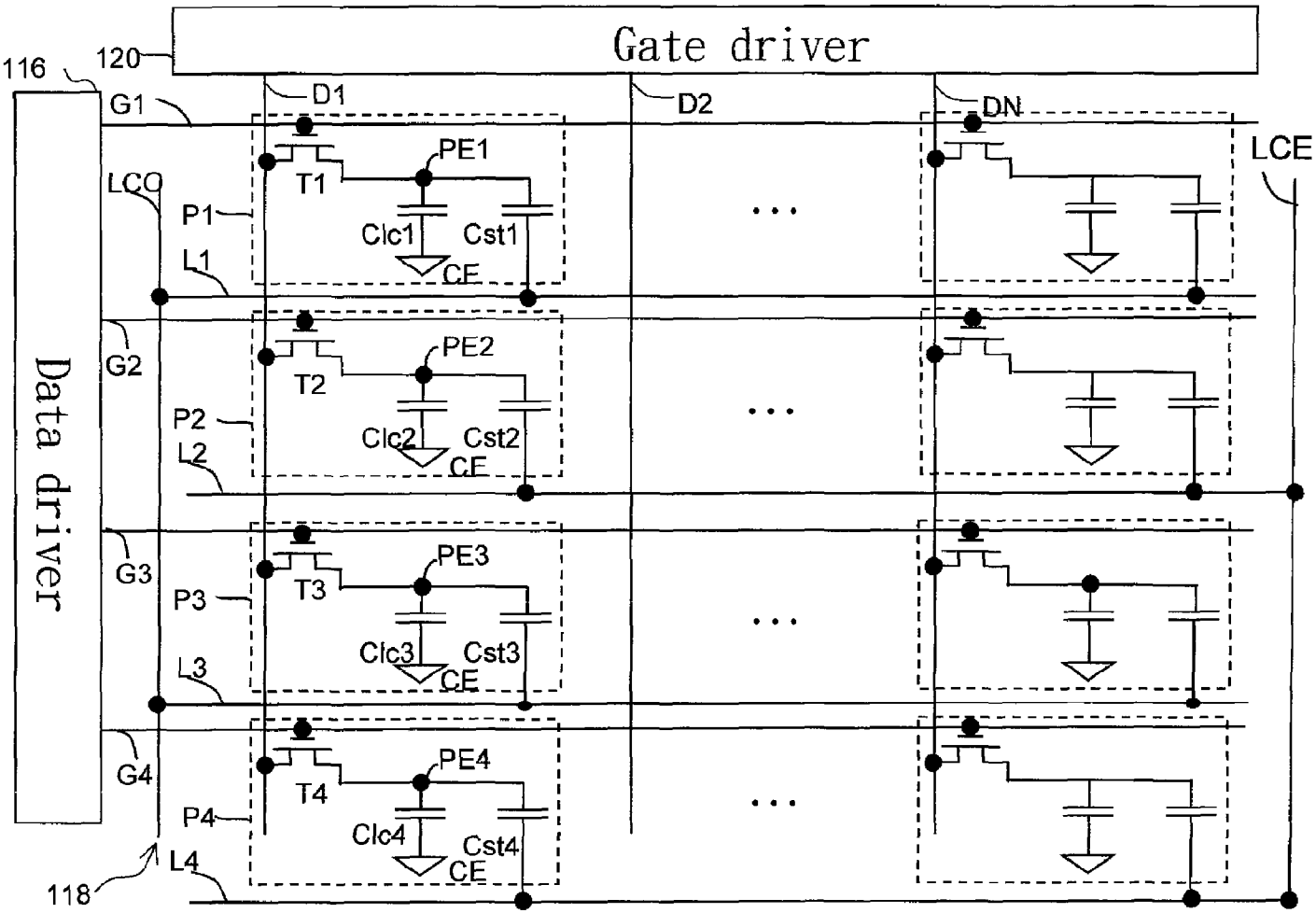
FIG. 1 is an equivalent circuit diagram showing a pixel array of a liquid crystal display according to a first embodiment of the invention.
Figure 2:
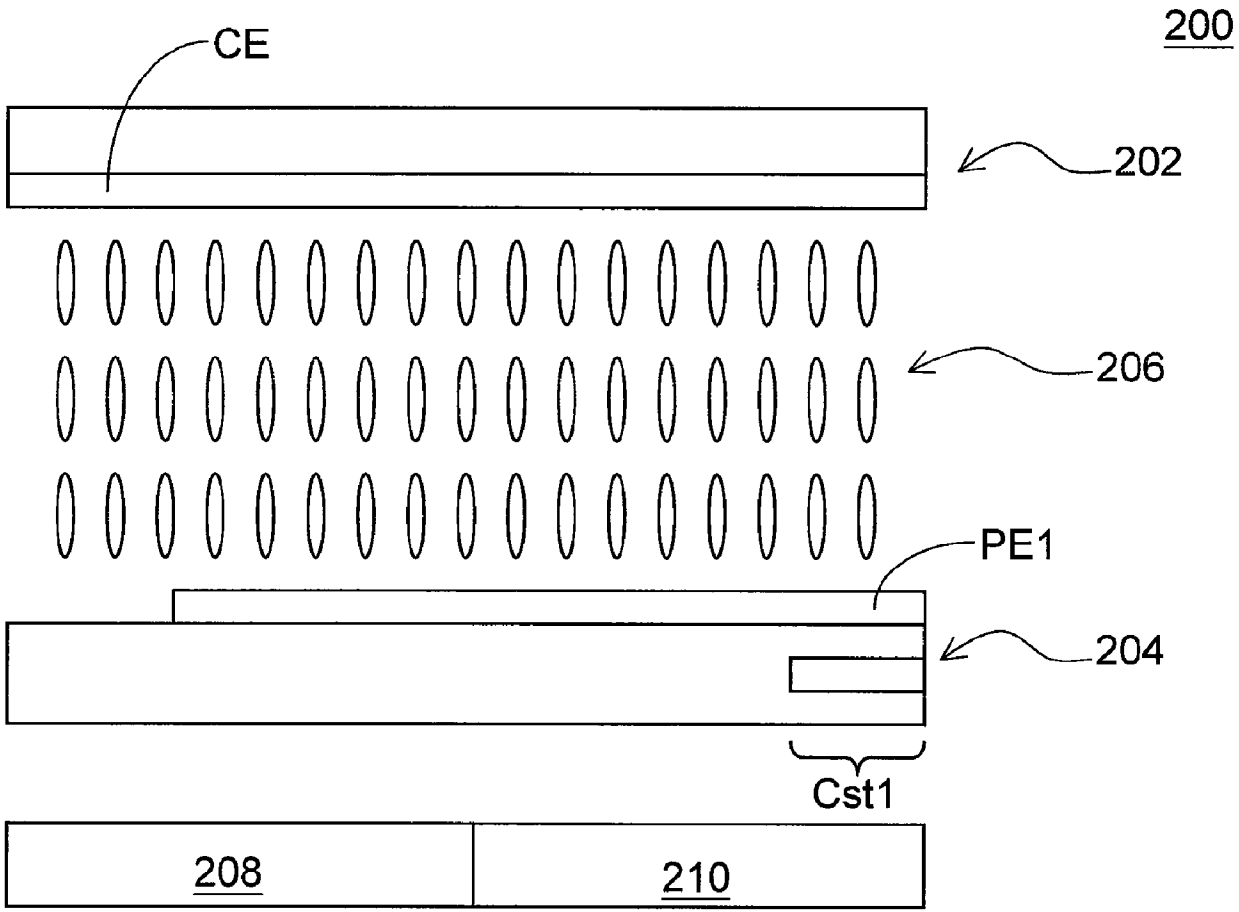
FIG. 2 is a schematic illustration showing a portion of the liquid crystal display according to the first embodiment of the invention.
Figure 3:
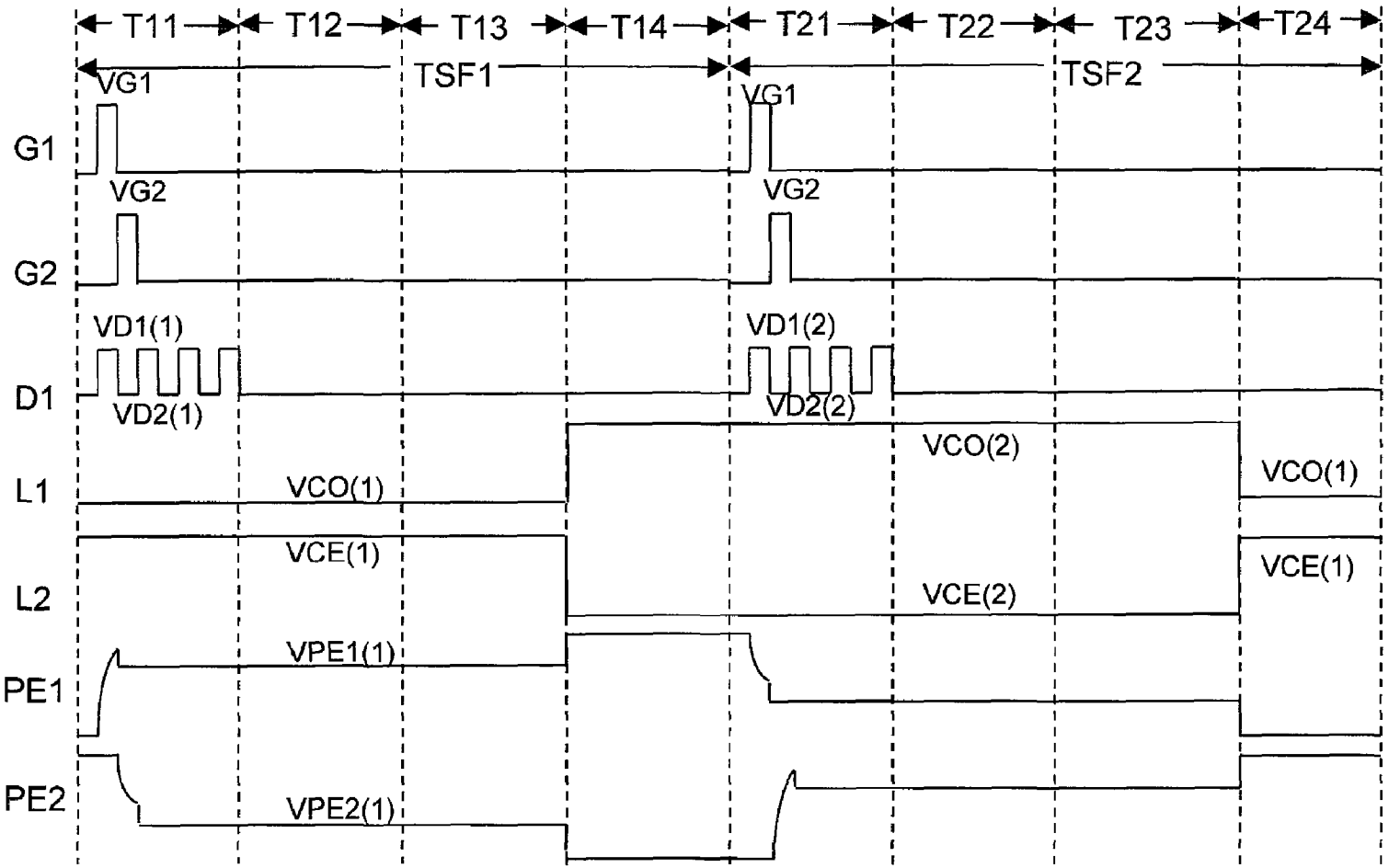
FIG. 3 shows driving waveforms in a driving method of the liquid crystal display according to the first embodiment of the invention.

FIG. 1 is an equivalent circuit diagram showing a pixel array of a liquid crystal display 200 according to a first embodiment of the invention. FIG. 2 is a schematic illustration showing a portion of the liquid crystal display according to the first embodiment of the invention. FIG. 3 shows driving waveforms in a driving method of the liquid crystal display according to the first embodiment of the invention. Referring to FIGS. 1 to 3, the liquid crystal display 200 of this embodiment includes a first substrate 202, a second substrate 204, a liquid crystal layer 206, at least one first color light source 208 and a second color light source 210, a gate driver 116 and a common line L1.

The first substrate 202 includes a common electrode CE. The second substrate 204 includes at least one data line, at least one scanning line and a pixel array 118. The at least one data line includes, for example, data lines D1 to DN, wherein N is a positive integer. The at least one scanning line includes multiple scanning lines, such as scanning lines G1 to G4 depicted in FIG. 1 for the sake of simplicity. The pixel array 118 is coupled to the data lines D1 to DN and all scanning lines. The pixel array 118 includes a pixel, such as a first pixel P1. The first pixel P1 has a first storage capacitor Cst1 and a first pixel electrode PE1.

The liquid crystal layer 206 is disposed between the first substrate 202 and the second substrate 204. The common electrode CE, the first pixel electrode PE1 and the liquid crystal layer 206 form a first liquid crystal capacitor Clc1. The gate driver 116 drives the pixel array 118 through the multiple scanning lines within a frame period. One frame period includes a first sub-frame period TSF1 and a second sub-frame period TSF2. The first sub-frame period TSF1 includes a first data writing interval T11, and the second sub-frame period TSF2 includes a second data writing interval T21.

The common line L1 provides at least one first common voltage VCO(1) and a second common voltage VCO(2). The first storage capacitor Cst(1) is coupled to and between the common line L1 and the first pixel electrode PE1.

In the first data writing interval T11, a first data voltage VD1(1) is transmitted to the first pixel P1. After the first data writing interval T11, the first color light source 208 illuminates the first pixel P1. In the second data writing interval T21, a second data voltage VD1(2) is transmitted to the first pixel P1. After the second data writing interval T21, the second color light source 210 illuminates the first pixel P1. In a reset interval T14 between the first data writing interval T11 and the second data writing interval T21, a voltage of the common line L1 is changed from the first common voltage VCO(1) to the second common voltage VCO(2) so that a voltage of the first liquid crystal capacitor Clc1 is changed.

Accordingly, after the voltage of the common line L1 is changed, the voltage of the first pixel electrode PE1 may be changed according to the coupling of the first storage capacitor Cst1. Thus, a crossover voltage of the first liquid crystal capacitor Clc1 is correspondingly changed so that the first pixel P1 is equivalent to a pixel receiving a data voltage corresponding to a discriminated gray-scale value. The discriminated gray-scale value is the gray-scale value corresponding to a substantially highest response speed of the liquid crystal molecule. Taking a normally-white twisted nematic (TN) type liquid crystal molecule as an example, the liquid crystal molecule of the low gray-scale value has the highest response speed, so the discriminated gray-scale value of the TN type liquid crystal display is preferably a low gray-scale value, such as 0. The above-mentioned discriminated gray-scale value may be selected according to the property of the liquid crystal molecule of the liquid crystal display. Consequently, enabling the first pixel P1 to receive one data voltage of the discriminated gray-scale value may speed up the response speed of the liquid crystal molecule in a next sub-frame so that the first pixel P1 may have the required brightness in the next sub-frame when the color light source turns on.

Consequently, when the same data voltage is inputted to an upper half portion of the panel and a lower half portion of the panel, the color of the display frame in the lower half portion of the panel may be closer to that in the upper half portion of the panel so that the color uniformity can be enhanced, the color error may be reduced, and it is possible to prevent the incorrect color from being displayed. In addition, changing the voltage of the liquid crystal capacitor may also increase the discrimination of different colors displayed by the pixel within the adjacent sub-frame periods so that the image quality may be enhanced.

Detailed descriptions will be described in the following. The pixel P1 is equivalent to a thin film transistor T1, a liquid crystal capacitor Clc1 and a storage capacitor Cst1, while the pixel P2 is equivalent to a thin film transistor T2, a liquid crystal capacitor Clc2 and a storage capacitor Cst2. The pixels P3 and P4 are respectively equivalent to thin film transistors T3 and T4, liquid crystal capacitors Clc3 and Clc4 and storage capacitors Cst3 and Cst4. The common electrode CE is applied with a common voltage Vcom (not shown), which is substantially always kept constant.

The thin film transistor T1 includes a first gate, a first source and a first drain. The first gate is controlled by the scanning line G1, the first source is coupled to the data line D1, and the first drain is coupled to the pixel electrode PE1. The thin film transistor T2 includes a second gate, a second source and a second drain. The second gate is controlled by the scanning line G2, the second source is coupled to the data line D1 and the second drain is coupled to a pixel electrode PE2. The thin film transistor T3 is coupled to the data line D1 and the scanning line G3, while the thin film transistor T4 is coupled to the data line D1 and the scanning line G4.

A data driver 120 is coupled to the data lines D1 to DN to provide the voltages for the corresponding pixels. The gate driver 116 is coupled to the scanning lines G1 to G4 to control the corresponding pixels.

A common bus line LCO is preferably substantially disposed parallel to the data lines D1 to DN and coupled to each of the odd-numbered rows of common lines L1 and L3. Each of the odd-numbered rows of common lines L1 and L3 is preferably disposed perpendicular to the common bus line LCO. For the sake of simplification, FIG. 1 only representatively labels two odd-numbered rows of common lines L1 and L3.

Similarly, a common bus line LCE is preferably disposed substantially parallel to the data lines D1 to DN and coupled to each of the even-numbered rows of common lines L2 and L4. Each of the even-numbered rows of common lines L2 and L4 is preferably disposed perpendicular to the common bus line LCE. For the sake of simplicity, FIG. 1 only representatively labels two even-numbered rows of common lines L2 and L4.

Preferably, the liquid crystal display 200 further includes a third color light source, and one frame period preferably further includes a third sub-frame period (not shown). The first color light source 208, the second color light source 210 and the third color light source are preferably red, green and blue color light sources.

The red, green and blue color light sources sequentially turn on in the first sub-frame period TSF1, the second sub-frame period TSF2, and the third sub-frame period so that the first pixel P1 sequentially generates red, green and blue images, which are mixed so that the desired color of the first pixel P1 may be obtained.

In addition, each sub-frame period is preferably divided into four time intervals including a data writing interval, a waiting interval, a turn-on interval and a reset interval. For example, the sub-frame period TSF1 is divided into a data writing interval T11, a waiting interval T12, a turn-on interval T13 and a reset interval T14.

As shown in FIG. 3, in the data writing interval T11, the gate driver 116 sequentially provides gate voltages VG1 and VG2 through the scanning lines G1 and G2 to control the pixels P1 and P2. At this time, when the embodiment adopts a row inversion driving method, the data driver 120 provides first data voltages VD1(1) and VD2(1) with inverse polarities to the pixels P1 and P2 through the data line D1 so that the pixel electrodes PE1 and PE2 reach the desired data voltages VPE1(1) and VPE2(1).

The waiting interval T12 enables the liquid crystal molecule to have enough time to response to the required tilt angle. Next, one of the red, green and blue color light sources will be turned on in the turn-on interval T13 to illuminate the pixels P1 and P2. The color light source may be a cold cathode fluorescent lamp or a light emitting diode.

Thereafter, the voltage of the common line L1 is changed from the first common voltage VCO(1) to the second common voltage VCO(2), and the voltage of the common line L2 is changed from a first common voltage VCE(1) to a second common voltage VCE(2) in the reset interval T14. When the liquid crystal display 200 adopts the row inversion driving method to drive the pixels, the pixels P1 and P2 have reverse voltage polarities, so the common lines L1 and L2 have inverse voltages.

A difference between the first common voltage VCO(1) and the second common voltage VCO(2) is a constant difference, which does not relate to the first data voltage VD1(1) and the second data voltage VD1(2). A difference between the first common voltage VCE(1) and the second common voltage VCE(2) is another constant difference, which does not relate to the data voltage VD2(1) and the second data voltage VD2(2).

Illustrations will be made in an example, which takes a crossover voltage of the liquid crystal capacitor corresponding to the discriminated gray-scale value of the liquid crystal display as a maximum crossover voltage. After the voltage of the common line L1 is changed from the first common voltage VCO(1) to the second common voltage VCO(2), the voltage of the first liquid crystal capacitor Clc1 is the maximum voltage among all voltages corresponding to the liquid crystal capacitors when all gray-scale values are displayed. After the voltage of the common line L2 is changed from the first common voltage VCE(1) to the second common voltage VCE (2), the absolute value of the voltage of the liquid crystal capacitor Clc2 is a maximum value among all the absolute values of all the voltages corresponding to the liquid crystal capacitor when all the gray-scale values are displayed.

That is, when the voltage of the common line L1 is increased from the first common voltage VCO(1) to the second common voltage VCO(2), the voltage of the pixel electrode PE1, which is positively driven is increased, so that the voltage difference between the pixel electrode PE1 and the common electrode CE, which has the common voltage Vcom, is increased and the crossover voltage of the liquid crystal capacitor Clc(1) is increased. Thus, the pixel P1 is equivalent to a pixel, which receives the data voltage of the discriminated gray-scale value. At this time, the response speed of the liquid crystal molecule is increased, and the response speed of the liquid crystal molecule in the next sub-frame period is simultaneously increased.

Similarly, when the voltage of the common line L2 is decreased from the first common voltage VCE(1) to the second common voltage VCE(2), the voltage of the negatively driven pixel electrode PE2 is also decreased, so that the voltage difference between the common electrode CE, which has the common voltage Vcom, and pixel electrode PE2 is increased, and the absolute value of the crossover voltage of the liquid crystal capacitor Clc(2) is increased. Consequently, the pixel P2 is equivalent to a pixel, which receives the data voltage of the discriminated gray-scale value. At this time, the response speed of the liquid crystal molecule is increased, and the response speed of the liquid crystal molecule in the next sub-frame period is simultaneously increased.

Thus, the pixels P1 and P2 in the next sub-frame period can rapidly represent the desired brightnesses, and the phenomena of the non-uniform color or the incorrectly mixed color can be effectively improved.

Second Embodiment

Figure 4:
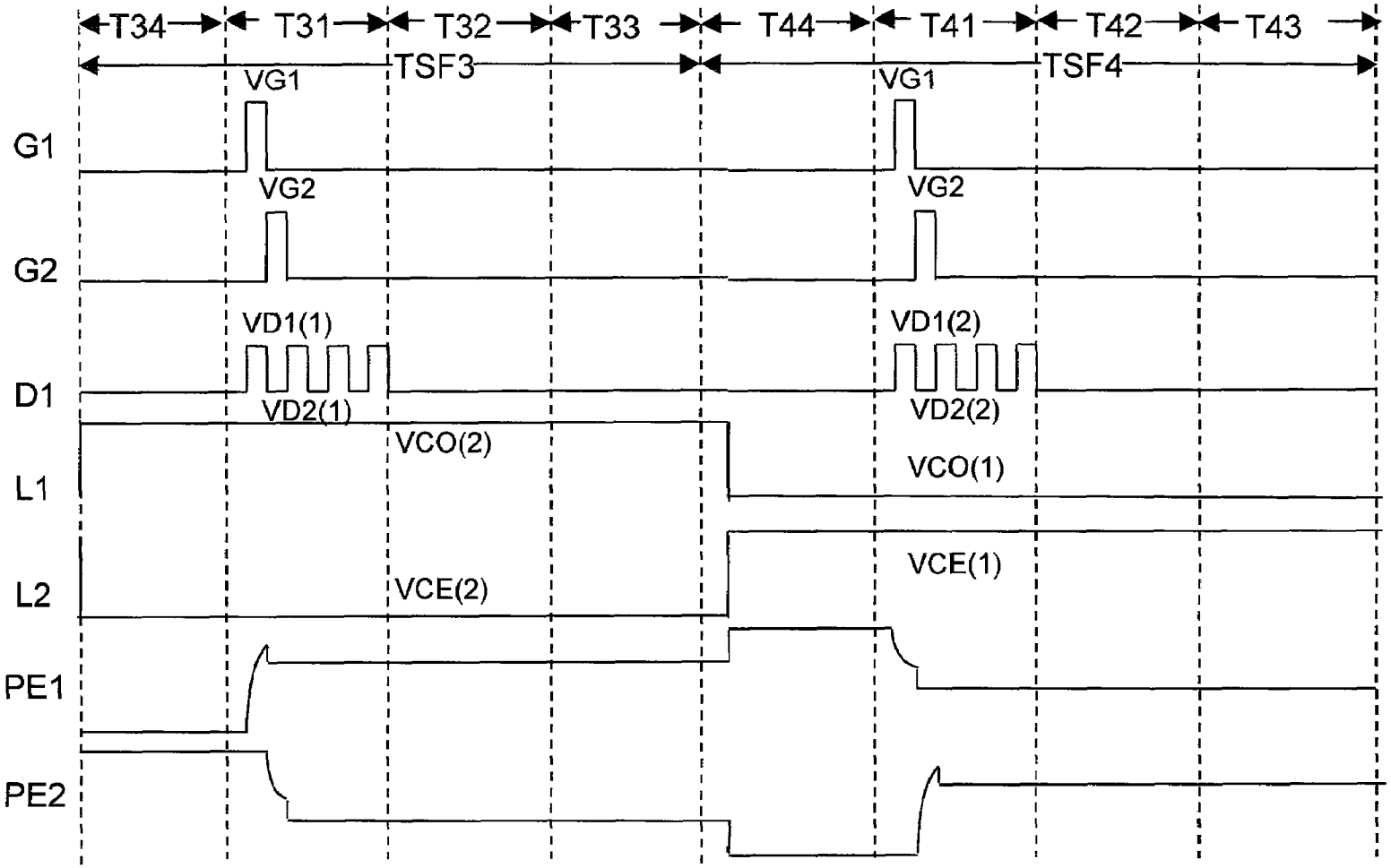
FIG. 4 shows driving waveforms in a driving method of a liquid crystal display according to a second embodiment of the invention.

FIG. 4 shows driving waveforms in a driving method of a liquid crystal display according to a second embodiment of the invention. The difference between the first and second embodiments will be described in the following. In the first embodiment, the reset interval follows the first data writing interval within one sub-frame period. In the second embodiment, however, the data writing interval follows the reset interval within the sub-frame period. For example, the second data writing interval T41 follows the reset interval T44. Consequently, the response speed of the liquid crystal molecule within the sub-frame period TSF4 may also be increased.

Third Embodiment

Figure 5:
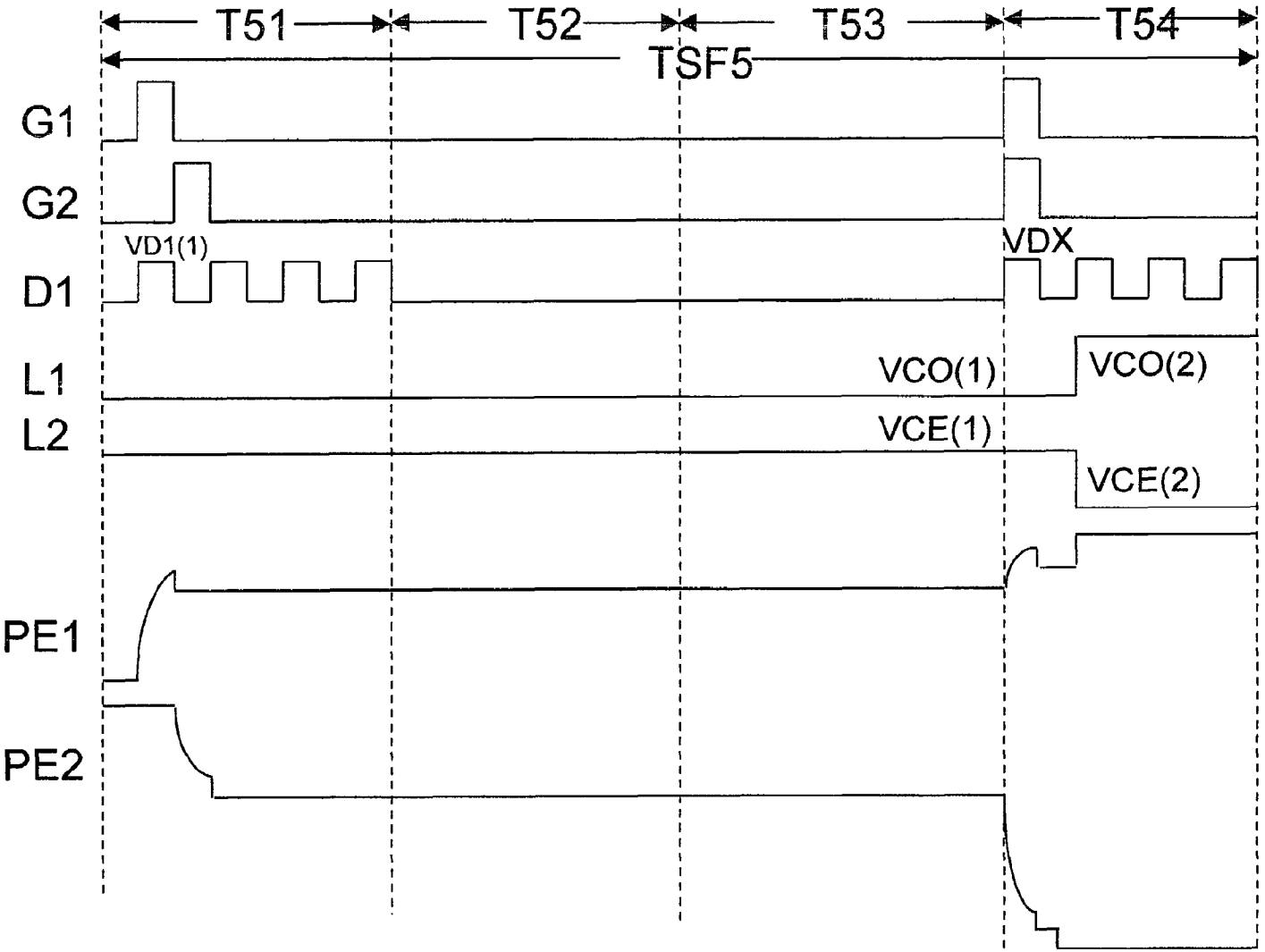
FIG. 5 shows driving waveforms in a driving method of a liquid crystal display according to a third embodiment of the invention.

FIG. 5 shows driving waveforms in a driving method of a liquid crystal display according to a third embodiment of the invention. Unlike the first embodiment, a predetermined voltage is further simultaneously transmitted to the first pixel P1 and the second pixel P2 through the data line D1 within the reset interval in the third embodiment so that the voltages of the first liquid crystal capacitor Clc1 and the second liquid crystal capacitor Clc2 are changed.

In detail, as shown in FIG. 5, the scanning lines G1 and G2 are simultaneously enabled in the reset interval T54 so that the thin film transistors T1 and T2 simultaneously turn on. Thus, the thin film transistors T1 and T2 simultaneously receive the data voltage VDX to change the voltages of the liquid crystal capacitors Clc1 and Clc2 of the pixels P1 and P2. Thereafter, the voltages of the common lines L1 and L2 are changed. After the voltages of the common lines L1 and L2 are changed, the absolute values of the voltages of the liquid crystal capacitors Clc1 and Clc2 according to the third embodiment may be greater than the absolute values of the voltages of the liquid crystal capacitors Clc1 and Clc2 according to the first embodiment. Thus, the response speed of the liquid crystal molecule may be faster.

The predetermined voltage VDX is the data voltage corresponding to the discriminated gray-scale value. For example, when the data voltage of the discriminated gray-scale value corresponds to the black data voltage, the predetermined voltage VDX is substantially the black data voltage. That is, when the first data voltage VD1(1) is the black data voltage, the predetermined voltage VDX is substantially equal to the first data voltage VD1(1).

In addition, the first pixel P1 and the second pixel P2 in this embodiment are preferably driven by the data voltages with different polarities. The time instant of changing the voltages of the common lines L1 and L2 may also be earlier than the time instant when the thin film transistors T1 and T2 simultaneously receive the data voltage VDX.

Fourth Embodiment

Figure 6:
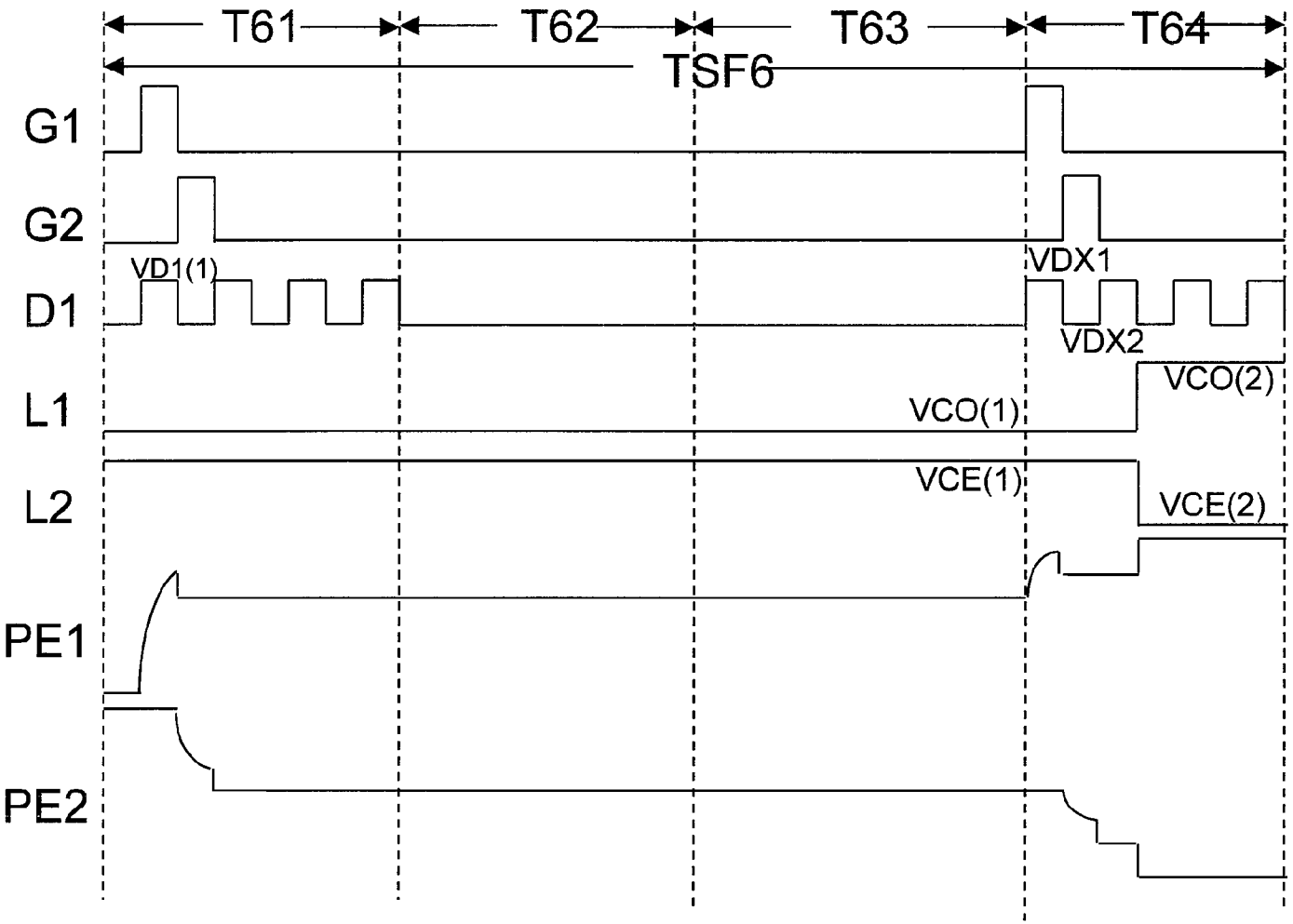
FIG. 6 shows driving waveforms in a driving method of a liquid crystal display according to a fourth embodiment of the invention.

FIG. 6 shows driving waveforms in a driving method of a liquid crystal display according to a fourth embodiment of the invention. Unlike the first embodiment, the fourth embodiment further sequentially enables the first scanning line G1 and the second scanning line G2 in the reset interval, such as T64, and the first predetermined voltage VDX1 and the second predetermined voltage VDX2 are further sequentially inputted to the first pixel P1 and the second pixel P2 so that the voltages of the first liquid crystal capacitor Clc1 and the second liquid crystal capacitor Clc2 may be sequentially changed.

This embodiment also has the advantage of enabling the response speed of the liquid crystal molecule to be higher than that of the first embodiment. This embodiment is suitable for the condition that the first pixel P1 and the second pixel P2 are respectively driven by the data voltages with different polarities. When the first data voltage VD1(1) is the black data voltage, the first predetermined voltage VDX1 is equal to the first data voltage VD1(1).

Similarly, the time instant of changing the voltages of the common lines L1 and L2 may be earlier than the time instant when the thin film transistors T1 and T2 sequentially receive the data voltages VDX1 and VDX2.

Fifth Embodiment

Figure 7:
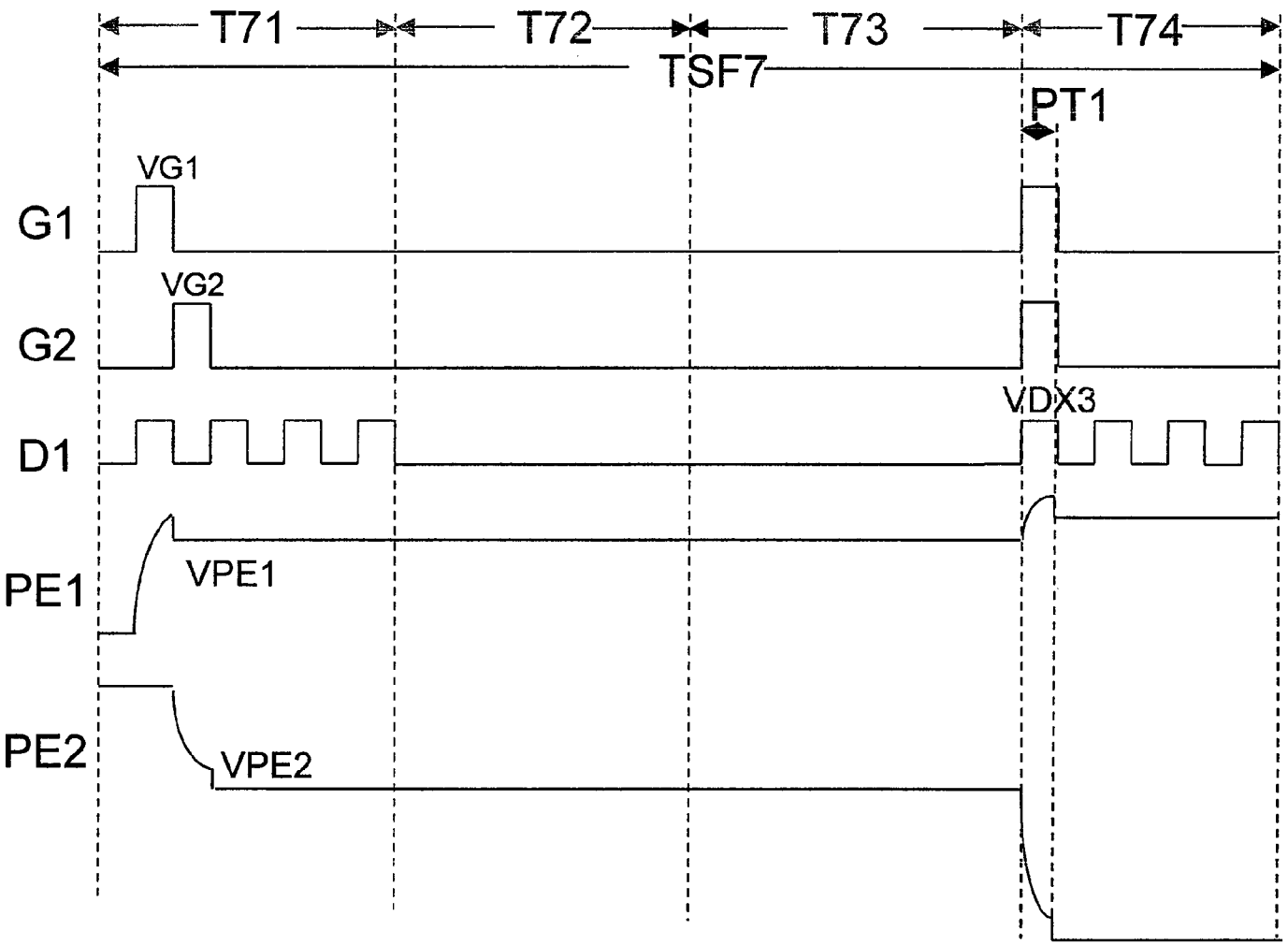
FIG. 7 shows driving waveforms in a driving method of a liquid crystal display according to a fifth embodiment of the invention.

FIG. 7 shows driving waveforms in a driving method of a liquid crystal display according to a fifth embodiment of the invention. Unlike the first embodiment, the fifth embodiment enables the first scanning line G1 and the second scanning line G2 simultaneously in the first data writing interval, such as T71, and a first pulse cycle PT1 within the second data writing interval (not shown) of the next sub-frame period, and the predetermined voltage VDX3 is simultaneously inputted to the first pixel P1 and the second pixel P2 so that the voltages of the first liquid crystal capacitor Clc1 and the second liquid crystal capacitor Clc2 are changed simultaneously. The common lines L1 and L2 of this embodiment can keep in a constant voltage during the reset interval T74, and no voltage change occurs.

The first pulse cycle PT1 is preferable located within the reset interval T74 of the sub-frame period TSF7. The reset interval T74 may also be earlier than the data writing interval T11 of the sub-frame period TSF7. The predetermined voltage VDX3 is preferably the data voltage of the discriminated gray-scale value. Thus, the response speed of the liquid crystal molecule in the next sub-frame period may also be increased without changing the voltages of the common lines L1 and L2.

In addition, the first scanning line G1 and the second scanning line G2 may also be sequentially enabled within the first pulse cycle PT1 so that the predetermined voltage VDX3 may be sequentially inputted to the first pixel P1 and the second pixel P2.

Sixth Embodiment

Figure 8:
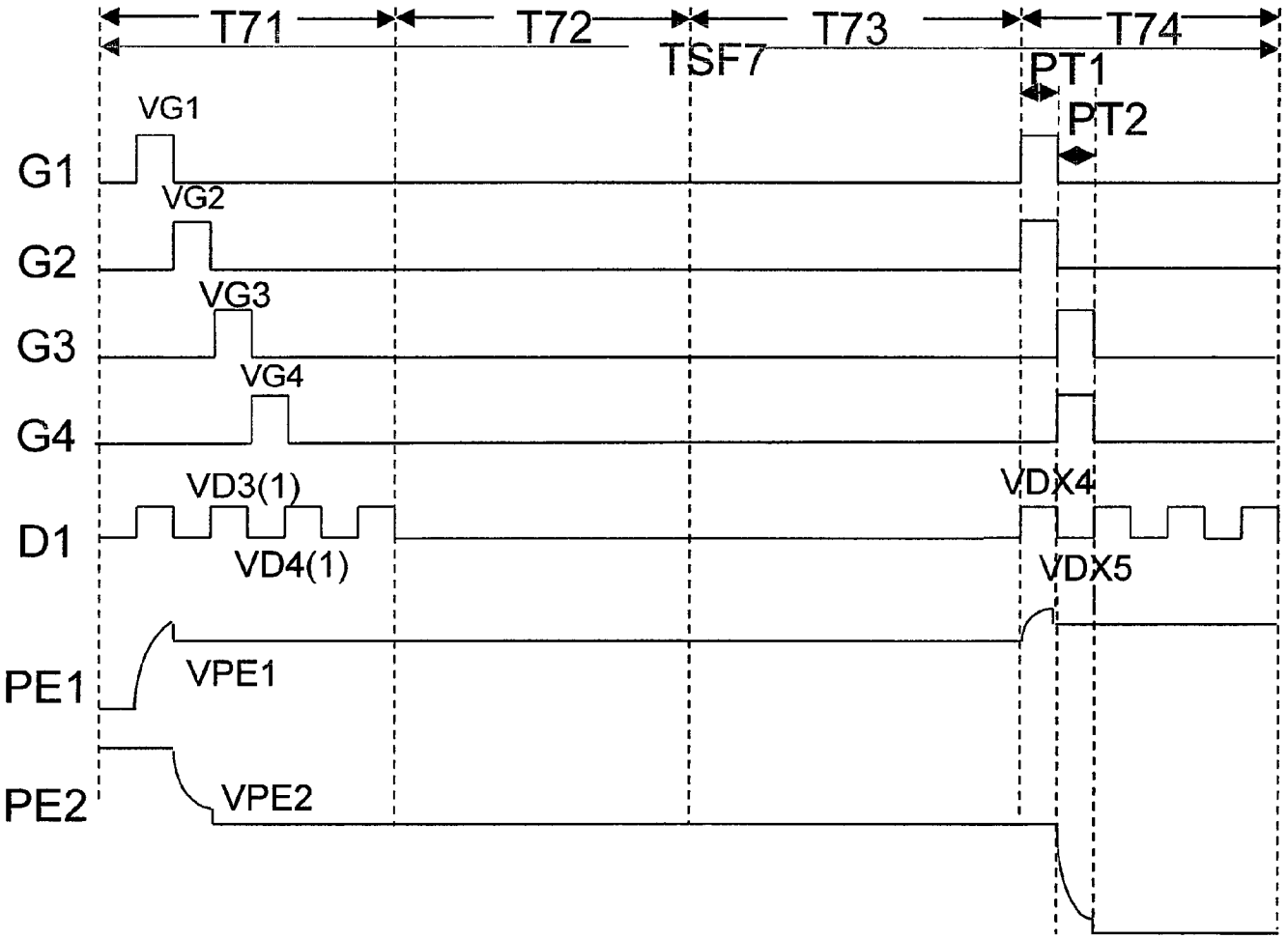
FIG. 8 shows driving waveforms in a driving method of a liquid crystal display according to a sixth embodiment of the invention.

FIG. 8 shows driving waveforms in a driving method of a liquid crystal display according to a sixth embodiment of the invention. Unlike the fifth embodiment, all the scanning lines of the liquid crystal display 200 are classified into a first group of scanning lines and a second group of scanning lines. This embodiment includes the first pulse cycle PT1, in which the predetermined voltage VDX4 is inputted to the pixels corresponding to the first group of scanning lines, and further includes a second pulse cycle PT2, in which the predetermined voltage VDX5 is inputted to the pixels corresponding to the second group of scanning lines. For example, the first group of scanning lines includes the first scanning line G1 and the second scanning line G2, and the second group of scanning lines includes the third scanning line G3 and the fourth scanning line G4. In the first data writing interval, such as the first data writing interval T71, the data voltages VD3(1) and the data voltage VD4(1) are respectively transmitted to the third pixel P3 and the pixel P4. In another data writing interval (not shown in FIG. 8) of the next sub-frame period, other two data voltages are respectively transmitted to the third pixel P3 and the fourth pixel P4. During the second pulse cycle PT2, which is between the data writing interval T71 and another data writing interval of the next sub-frame period, the third scanning line G3 and the fourth scanning line G4 are simultaneously enabled so that the predetermined voltage VDX5 is inputted to the third pixel P3 and the fourth pixel P4, and the voltages of the third liquid crystal capacitor Clc3 and the fourth liquid crystal capacitor Clc4 may be simultaneously changed. The first pulse cycle PT1 and the second pulse cycle PT2 do not overlap with each other.

The liquid crystal displays and the driving methods of the color sequential methods according to the embodiments of the invention have the advantages of enhancing the color uniformity of the panel, decreasing the color error, and preventing the incorrect color from being displayed. In addition, the discrimination between different colors displayed by the pixel within adjacent sub-frame periods can be enhanced so that the image quality may be enhanced.

While the invention has been described by way of examples and in terms of preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A liquid crystal display, comprising:

a first substrate comprising a common electrode;

a second substrate, which comprises:

at least one data line comprising a first data line;

a plurality of scanning lines comprising a first scanning line and a second scanning line; and a pixel array coupled to the at least one data line and the scanning lines, wherein the pixel array comprises a first pixel and a second pixel, the first pixel is coupled to the first data line and the first scanning line, the second pixel is coupled to the first data line and the second scanning line, the first pixel has a first storage capacitor and a first pixel electrode, and the second pixel has a second storage capacitor and a second pixel electrode;

a liquid crystal layer disposed between the first substrate and the second substrate, wherein the common electrode, the first pixel electrode and the liquid crystal layer form a first liquid crystal capacitor, and the common electrode, the second pixel electrode and the liquid crystal layer form a second liquid crystal capacitor;

at least one first color light source and a second color light source; and a gate driver for driving the pixel array through the scanning lines within a frame period, the frame period comprises a first sub-frame period comprising a first data writing interval, and a second sub-frame period comprising a second data writing interval, wherein:

in the first data writing interval, a first data voltage and a second data voltage are respectively transmitted to the first pixel and the second pixel;

after the first data writing interval, the first color light source illuminates the first pixel and the second pixel;

in the second data writing interval, a third data voltage and a fourth data voltage are respectively transmitted to the first pixel and the second pixel;

after the second data writing interval, the second color light source illuminates the first pixel and the second pixel; and in a first pulse cycle between the first data writing interval and the second data writing interval, the first scanning line and the second scanning line are simultaneously enabled, and a predetermined voltage is simultaneously inputted to the first pixel and the second pixel so that voltages of the first liquid crystal capacitor and the second liquid crystal capacitor are simultaneously changed.

2. The display according to claim 1, wherein:

the scanning lines are classified into a first group of scanning lines and a second group of scanning lines;

the first group of scanning lines comprises the first scanning line and the second scanning line;

the second group of scanning lines comprises a third scanning line and a fourth scanning line;

the pixel array further comprises a third pixel, which has a third storage capacitor and a third pixel electrode, and a fourth pixel, which has a fourth storage capacitor and a fourth pixel electrode;

the third pixel is coupled to the first data line and the third scanning line;

the fourth pixel is coupled to the first data line and the fourth scanning line;

the third pixel electrode and the liquid crystal layer form a third liquid crystal capacitor, while the common electrode, the fourth pixel electrode and the liquid crystal layer form a fourth liquid crystal capacitor;

in the first data writing interval, a fifth data voltage and a sixth data voltage are respectively transmitted to the third pixel and the fourth pixel;

in the second data writing interval, a seventh data voltage and an eighth data voltage are respectively transmitted to the third pixel and the fourth pixel;

in a second pulse cycle between the first data writing interval and the second data writing interval, the third scanning line and the fourth scanning line are simultaneously enabled to simultaneously change voltages of the third liquid crystal capacitor and the fourth liquid crystal capacitor; and the first pulse cycle and the second pulse cycle do not overlap with each other.

3. A driving method of a liquid crystal display, the liquid crystal display comprising a first substrate, a second substrate, a liquid crystal layer, at least one first color light source and a second color light source, a gate driver and a common line, the first substrate comprising a common electrode, the second substrate comprising at least one data line, at least one scanning line and a pixel array, the pixel array being coupled to the at least one data line and the at least one scanning line, the pixel array comprising a first pixel having a first storage capacitor and a first pixel electrode, the liquid crystal layer being disposed between the first substrate and the second substrate, the common electrode, the first pixel electrode and the liquid crystal layer forming a first liquid crystal capacitor, the first storage capacitor is coupled to and between the common line and the first pixel electrode, the method comprising the steps of:

(a) enabling the gate driver to drive the first pixel within a first sub-frame period comprising a first data writing interval, in which a first data voltage is transmitted to the first pixel, wherein the first color light source illuminates the first pixel after the first data writing interval;

(b) changing a voltage of the common line from a first common voltage to a second common voltage within a reset interval after the first data writing interval so that a voltage of the first liquid crystal capacitor is changed; and (c) enabling the gate driver to drive the first pixel within a second sub-frame period comprising a second data writing interval, which follows the reset interval, wherein a second data voltage is transmitted to the first pixel in the second data writing interval, and the second color light source illuminates the first pixel after the second data writing interval.

4. The method according to claim 3, wherein the pixel array further comprises a second pixel, the second pixel has a second storage capacitor and a second pixel electrode, the common electrode, the second pixel electrode and the liquid crystal layer form a second liquid crystal capacitor, the at least one data line comprises a first data line, the first pixel and the second pixel are both coupled to the first data line, and step (b) further comprises:

simultaneously transmitting a predetermined voltage to the first pixel and the second pixel through the first data line in the reset interval so that the voltages of the first liquid crystal capacitor and the second liquid crystal capacitor are changed.

5. The method according to claim 3, wherein the pixel array further comprises a second pixel having a second storage capacitor and a second pixel electrode, the common electrode, the second pixel electrode and the liquid crystal layer form a second liquid crystal capacitor, the at least one data line comprises a first data line, the at least one scanning line comprises a first scanning line and a second scanning line, the first pixel is coupled to the first data line and the first scanning line, the second pixel is coupled to the first data line and the second scanning line, and step (b) further comprises:

sequentially enabling the first scanning line and the second scanning line in the reset interval and sequentially inputting a first predetermined voltage and a second predetermined voltage to the first pixel and the second pixel through the first data line to sequentially change the voltages of the first liquid crystal capacitor and the second liquid crystal capacitor.

6. The method according to claim 3, wherein a difference between the first common voltage and the second common voltage is a constant difference, which does not relate to the first data voltage and the second data voltage.

7. The method according to claim 3, wherein after the voltage of the common line is changed from the first common voltage to the second common voltage, the voltage of the first liquid crystal capacitor is a maximum one of all voltages of the corresponding liquid crystal capacitors when all gray-scale values are displayed.

8. A driving method of a liquid crystal display panel, the liquid crystal display panel comprising a first substrate, a second substrate, a liquid crystal layer, at least one first color light source and a second color light source, a gate driver and a common line, the first substrate comprising a common electrode, the second substrate comprising at least one data line, at least one scanning line and a pixel array, the pixel array being coupled to the at least one data line and the at least one scanning line, the pixel array comprising a first pixel and a second pixel, the first pixel being coupled to a first data line and a first scanning line, the second pixel being coupled to the first data line and a second scanning line, the first pixel having a first storage capacitor and a first pixel electrode, the second pixel having a second storage capacitor and a second pixel electrode, the liquid crystal layer being disposed between the first substrate and the second substrate, the common electrode, the first pixel electrode and the liquid crystal layer forming a first liquid crystal capacitor, the common electrode, the second pixel electrode and the liquid crystal layer form a second liquid crystal capacitor, and the method comprising the steps of:

(a) enabling the gate driver to drive the first pixel and the second pixel within a first sub-frame period comprising a first data writing interval, wherein a first data voltage and a second data voltage are transmitted to the first pixel and the second pixel, respectively, in the first data writing interval, and the first color light source illuminates the first pixel and the second pixel after the first data writing interval;

(b) enabling the first scanning line and the second scanning line simultaneously in a first pulse cycle after the first data writing interval, and simultaneously inputting a predetermined voltage to the first pixel and the second pixel to change voltages of the first liquid crystal capacitor and the second liquid crystal capacitor; and (c) enabling the gate driver to drive the first pixel and the second pixel within a second sub-frame period comprising a second data writing interval following the first pulse cycle, wherein a third data voltage and a fourth data voltage are respectively transmitted to the first pixel and the second pixel in the second data writing interval, and the second color light source illuminates the first pixel and the second pixel after the second data writing interval.

9. The method according to claim 8, wherein:

the scanning lines comprises a first group of scanning lines and a second group of scanning lines, the first group of scanning lines comprises the first scanning line and the second scanning line, the second group of scanning lines comprises a third scanning line and a fourth scanning line, the pixel array further comprises a third pixel and a fourth pixel, the third pixel has a third storage capacitor and a third pixel electrode, the fourth pixel has a fourth storage capacitor and a fourth pixel electrode, the third pixel is coupled to the first data line and the third scanning line, the fourth pixel is coupled to the first data line and the fourth scanning line, the third pixel electrode and the liquid crystal layer form a third liquid crystal capacitor, the common electrode, and the fourth pixel electrode and the liquid crystal layer form a fourth liquid crystal capacitor;

step (a) further comprises respectively transmitting a fifth data voltage and a sixth data voltage to the third pixel and the fourth pixel in the first data writing interval;

step (b) further comprises simultaneously enabling the third scanning line and the fourth scanning line in a second pulse cycle after the first data writing interval to simultaneously change voltages of the third liquid crystal capacitor and the fourth liquid crystal capacitor, and the first pulse cycle and the second pulse cycle do not overlap with each other; and step (c) further comprises respectively transmitting a seventh data voltage and an eighth data voltage to the third pixel and the fourth pixel in the second data writing interval.

10. A liquid crystal display, comprising:

a first substrate comprising a common electrode;

a second substrate, which comprises:

at least one data line;

at least one scanning line; and a pixel array coupled to the at least one data line and the at least one scanning line, the pixel array at least comprising a first pixel having a first storage capacitor and a first pixel electrode;

a liquid crystal layer disposed between the first substrate and the second substrate, wherein the common electrode, the first pixel electrode and the liquid crystal layer from a first liquid crystal capacitor;

at least one first color light source and a second color light source;

a gate driver for driving the pixel array within a frame period through the at least one scanning line, wherein the frame period comprises a first sub-frame period and a second sub-frame period, the first sub-frame period comprises a first data writing interval and the second sub-frame period comprises a second data writing interval; and a common line for providing at least a first common voltage and a second common voltage, the first storage capacitor being coupled between the common line and the first pixel electrode, wherein:

in the first data writing interval, a first data voltage is transmitted to the first pixel;

after the first data writing interval, the first color light source illuminates the first pixel;

in the second data writing interval, a second data voltage is transmitted to the first pixel;

after the second data writing interval, the second color light source illuminates the first pixel;

in a reset interval between the first data writing interval and the second data writing interval, a voltage of the common line is changed from the first common voltage to the second common voltage so that a voltage of the first liquid crystal capacitor is changed.

11. The display according to claim 10, wherein:

the pixel array further comprises a second pixel having a second storage capacitor and a second pixel electrode;

the common electrode, the second pixel electrode and the liquid crystal layer form a second liquid crystal capacitor;

the at least one data line comprises a first data line;

the first pixel and the second pixel are both coupled to the first data line; and in the reset interval, a predetermined voltage is simultaneously transmitted to the first pixel and the second pixel through the first data line so that voltages of the first liquid crystal capacitor and the second liquid crystal capacitor are changed.

12. The display according to claim 11, wherein when the first data voltage is a black data voltage, the predetermined voltage is substantially equal to the first data voltage.

13. The display according to claim 10, wherein:

the pixel array further comprises a second pixel having a second storage capacitor and a second pixel electrode, the common electrode, the second pixel electrode and the liquid crystal layer form a second liquid crystal capacitor, the at least one data line comprises a first data line for sequentially providing a first predetermined voltage and a second predetermined voltage, the at least one scanning line comprises a first scanning line and a second scanning line, the first pixel is coupled to the first data line and the first scanning line, and the second pixel is coupled to the first data line and the second scanning line; and in the reset interval, the first scanning line and the second scanning line are sequentially enabled and the first predetermined voltage and the second predetermined voltage are sequentially inputted to the first pixel and the second pixel so that the voltages of the first liquid crystal capacitor and the second liquid crystal capacitor are sequentially changed.

14. The display according to claim 13, wherein when the first data voltage is a black data voltage, the first predetermined voltage is equal to the first data voltage.

15. The display according to claim 10, wherein the difference between the first common voltage and the second common voltage is a constant difference which does not relate to the first data voltage and the second data voltage.

16. The display according to claim 10, wherein after the voltage of the common line is changed from the first common voltage to the second common voltage, the voltage of the first liquid crystal capacitor is a maximum one of all voltages of the corresponding liquid crystal capacitors when all gray-scale values are displayed.

17. The display according to claim 10, wherein the reset interval exists within the first sub-frame period, and the reset interval follows the first data writing interval.

18. The display according to claim 10, wherein the reset interval exists within the second sub-frame period, and the second data writing interval follows the reset interval.

* * * * *